US010024005B2

(12) United States Patent
Mahlberg et al.

(10) Patent No.: US 10,024,005 B2
(45) Date of Patent: Jul. 17, 2018

(54) SELF-PROPELLED ROAD MILLING MACHINE FOR WORKING ROAD SURFACES, AS WELL AS METHOD FOR WORKING ROAD SURFACES WITH A ROAD MILLING MACHINE

(71) Applicant: Wirtgen GmbH, Windhagen (DE)

(72) Inventors: Axel Mahlberg, Hennef (DE); Cyrus Barimani, Konigswinter (DE); Sebastian Boetzius, Siegburg (DE)

(73) Assignee: Wirtgen GmbH (DE)

( * ) Notice: Subject to any disclaimer, the term of this patent is extended or adjusted under 35 U.S.C. 154(b) by 211 days.

(21) Appl. No.: 14/974,530

(22) Filed: Dec. 18, 2015

(65) Prior Publication Data

US 2016/0186392 A1 Jun. 30, 2016

(30) Foreign Application Priority Data

Dec. 30, 2014 (DE) ..... 10 2014 227 037
May 27, 2015 (DE) ..... 10 2015 209 740

(51) Int. Cl.
*E01C 23/08* (2006.01)
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS 1,851,875 A * 3/1932 Siegel ..... A01B 29/00 172/122
3,767,262 A 10/1973 Pentith
(Continued)

FOREIGN PATENT DOCUMENTS

DE 2420330 A1 11/1975
DE 2540047 A1 3/1977
(Continued)

OTHER PUBLICATIONS

English summary of Japan Office Action in corresponding Japanese Patent Application JP 2015-254964, 2 pp. (not prior art).

*Primary Examiner* — John J Kreck
(74) *Attorney, Agent, or Firm* — Lucian Wayne Beavers; Patterson Intellectual Property Law, PC

(57) ABSTRACT

In a self-propelled road milling machine for working road surfaces, comprising a machine frame, comprising a milling drum mounted to rotate and extending in axial direction transverse to the direction of travel, and a milling drum housing enclosing the milling drum, where the milling drum comprises multiple tools circumferentially preferably arranged in the shape of a helix, where the tools, except for the axial peripheral area, feature a specified mutual line spacing, it is provided for the following features to be achieved: an oscillation drive exercises an oscillation stroke on the axis of the milling drum moving to and fro in axial direction relative to the machine frame, where the rotating movement of the tools is superimposable with an axial movement parallel to the axis of the milling drum, the stroke of which is adjustable to the line spacing between two axially neighboring tools.

22 Claims, 7 Drawing Sheets

(56) References Cited

U.S. PATENT DOCUMENTS

| | | | | |
|---|---|---|---|---|
| 5,029,652 | A * | 7/1991 | Whitfield | A01B 45/02 172/1 |
| 5,203,615 | A | 4/1993 | Zanetis et al. | |
| 5,244,306 | A * | 9/1993 | Artzberger | E02F 3/967 37/403 |
| 5,378,081 | A * | 1/1995 | Swisher, Jr. | E01C 23/088 299/39.5 |
| 5,382,084 | A | 1/1995 | Diver et al. | |
| 5,474,397 | A | 12/1995 | Lyons | |
| 5,695,256 | A | 12/1997 | Kishimoto | |
| 5,983,533 | A | 11/1999 | Bitelli | |
| 6,033,031 | A * | 3/2000 | Campbell | E01C 23/085 299/37.2 |
| 6,296,318 | B1 | 10/2001 | Simons et al. | |
| 6,457,779 | B1 | 10/2002 | Busley et al. | |
| 6,923,508 | B2 | 8/2005 | Holl et al. | |
| 7,131,704 | B2 | 11/2006 | Murray et al. | |
| 7,175,364 | B2 | 2/2007 | Gaertner et al. | |
| 7,370,916 | B2 | 5/2008 | Ley et al. | |
| 7,422,391 | B2 | 9/2008 | Holl et al. | |
| 7,438,364 | B2 | 10/2008 | Boehme et al. | |
| 7,644,994 | B2 | 1/2010 | Busley et al. | |
| 7,748,789 | B2 | 7/2010 | Freeburn | |
| 7,753,620 | B2 | 7/2010 | Kötting et al. | |
| 2004/0075330 | A1 | 4/2004 | Holl et al. | |
| 2005/0123350 | A1 | 6/2005 | Ley et al. | |
| 2008/0267706 | A1 | 10/2008 | Hall et al. | |
| 2009/0010713 | A1 | 1/2009 | Kotting et al. | |
| 2013/0195554 | A1 | 8/2013 | Rukavina et al. | |
| 2013/0234493 | A1 | 9/2013 | Emme et al. | |
| 2014/0361599 | A1 | 12/2014 | Losen et al. | |
| 2015/0076892 | A1 | 3/2015 | Emme et al. | |

FOREIGN PATENT DOCUMENTS

| | | | |
|---|---|---|---|
| DE | 8315139.7 | U1 | 2/1984 |
| DE | 3409389 | A1 | 10/1985 |
| DE | 3823480 | C1 | 10/1989 |
| DE | 19814053 | A1 | 10/1999 |
| DE | 10203732 | A1 | 8/2003 |
| EP | 0685598 | A1 | 12/1995 |
| EP | 0752501 | A1 | 1/1997 |
| EP | 1167626 | A1 | 1/2002 |
| EP | 1408158 | A1 | 4/2004 |
| EP | 1793041 | A1 | 6/2007 |
| EP | 2011921 | A2 | 1/2009 |
| GB | 2155525 | A | 9/1985 |
| JP | 62152663 | A | 7/1987 |
| JP | 5247910 | A | 9/1993 |
| JP | 0921107 | A | 1/1997 |
| JP | 09324404 | A | 12/1997 |
| JP | 11131420 | A | 5/1999 |

* cited by examiner

SELF-PROPELLED ROAD MILLING MACHINE FOR WORKING ROAD SURFACES, AS WELL AS METHOD FOR WORKING ROAD SURFACES WITH A ROAD MILLING MACHINE

BACKGROUND OF THE INVENTION

1. Field of the Invention

The invention relates to a self-propelled road milling machine for working road surfaces and a method for working road surfaces.

2. Description of the Prior Art

Such road milling machines are already generally known. For small milling machines, in which the milling drum is located level with the rear axle of the chassis and between the rear wheels, it is known to provide a rear support wheel or tracked ground-engaging unit on the zero side of the machine which can pivot inwards behind the outer contour of the road milling machine for close-to-edge milling.

Large milling machines are road milling machines, for example, in which the milling drum is mounted at the machine frame between the tracked ground-engaging units of the front axle and the rear axle, and at a distance to the same. EP 1 167 626 A1 (U.S. Pat. No. 7,644,994) describes such a large milling machine.

The milling drums of such milling machines comprise multiple tools circumferentially preferably arranged in the shape of a helix. These are usually milling tools which are fixed in place in toolholders welded onto a cylindrically hollow drum body or in toolholder systems. The tools therefore exhibit a constant line spacing which corresponds to the axial distance between neighbouring tools and, as a rule, ranges between 3 mm and 25 mm.

Due to the axial distance of the tools, a grooved texture is created on the milled surface during the milling process, wherein the mutual distance of neighbouring grooves corresponds to the line spacing.

In the process, the selection of the line spacing depends on the particular milling application. For the removal of complete pavements, for example, a larger line spacing is usually selected than for fine milling which merely serves to roughen the pavement surface at a small milling depth.

In simple terms, the reason for this is that milling drums with a small line spacing are not suitable for large milling depths due to the high tool density, whereas milling drums with a large line spacing do not achieve the desired texture for roughening the pavement as the grooved texture produced in the milled surface is too coarse.

Furthermore, in addition to the milling depth and desired surface texture, a multitude of other factors play a role in the selection of the line spacing, such as the nature of the ground to be worked, which leads to a multitude of different milling drums with different line spacings being available for different applications.

For milling contractors, this results in the necessity to maintain different milling machines and/or different types of milling drums for a milling machine for different applications.

This results in additional costs for the acquisition of additional machines, or an additional amount of work and expenditure of time, respectively, for conversion of the machines with different milling drums. This is of disadvantage in particular in those cases where different requirements need to be met on a single construction site and, as a result, different machines need to be transported to the operating site or a single machine needs to be converted on site.

SUMMARY OF THE INVENTION

It is therefore the object of the present invention to create a road milling machine for working road surfaces, as well as a method for working road surfaces, which enable a flexible usage for different milling applications, expand the possibilities of the milling operation, and can be used in a cost-saving and time-saving fashion.

The invention advantageously provides for an oscillation drive to exercise an oscillation stroke on the milling drum moving to and fro in axial direction relative to the machine frame, in which arrangement the rotating movement of the tools is superimposable with an axial movement parallel to the axis of the milling drum, the stroke of which is adjustable to the line spacing between two axially neighbouring tools.

The advantage according to the invention lies in the fact that large milling depths are now achievable and fine surface textures can also be created at the same time with a single roughing or standard drum.

As a result of the milling drum exercising an oscillation stroke moving to and fro in axial direction relative to the machine frame, the linear texture on the road surface can be altered or entirely removed, respectively. As a result, it is also possible to achieve a road surface with a texture that is not directly dependent on the line spacing of the milling drum. It also eliminates the necessity to use a milling drum which creates a finer linear texture on the milled surface. A further advantage is offered in that the altered surface texture of the road surface can also be achieved at larger milling depths. In the process, the tools perform a rotating movement about the axis of the milling drum which is superimposed by an axial movement parallel to the axis of the milling drum. The stroke of the displacement of the milling drum in axial direction can be adjusted in accordance with the line spacing of two axially neighbouring tools so that the oscillation stroke is variably adjustable for milling drums with a different tool density. This eliminates conversion times, and the provision of a multitude of milling drums for different applications can be reduced considerably.

In particular, the axial oscillation eliminates the need for fine and micro-fine milling drums which are cost-intensive due to the high tool density and high cutting tool wear per $m^3$.

In this way, both the complete removal of pavements and the removal of a surface course of a road surface only, or an increase of the skid resistance by means of roughening, can be performed effectively using, for example, a standard milling drum.

The invention advantageously provides for time and costs to be saved because both coarse textures as well as fine textures can be created with a single milling drum.

In so doing, advantages are furthermore also achieved in comparison to milling with conventional fine milling drums. The fine grooved texture created during fine milling may have a negative influence on the steering behaviour of, in particular two-wheeled, vehicles and lead to a self-steering behaviour. This formation of grooves parallel to the traffic lane is reduced due to the oscillation of the milling drum even if the oscillation stroke is smaller than the line spacing.

It is understood that the oscillation stroke need not precisely correspond to the line spacing but may also be adjusted to be smaller or larger, or may alternatively be switched off altogether so that the road milling machine can be operated in the conventional fashion.

It is preferably intended for the amplitude and/or the frequency of oscillation to be variably adjustable so that the type of texture created on the surface by the milling drum can be individually adapted to specific milling applications.

In this arrangement, the oscillation stroke can be adjusted in the range between the 0.5-fold to 1.5-fold, preferably between the 0.9-fold to 1.1-fold, of the line spacing. Alternatively, the oscillation stroke may be adjustable in the range between 3 mm and 40 mm.

The oscillation frequency may be adjustable, for example, between 0.1 and 20 Hz.

It may preferably be intended for the relation of the average speed magnitude of the oscillation stroke to the circumferential speed of the milling drum tools to be in the range between 0.1 and 3, preferably between 0.25 and 2.

In one embodiment, it is intended for the milling drum to comprise an axial support movable in axial direction. The movable axial support can be achieved in that the milling drum housing is displaced together with the milling drum, or in that the axial support is movable axially relative to the milling drum housing.

In a further embodiment, it may additionally be intended for a movement moving to and fro in the direction of travel to be superimposable on the axial support. This means that the milling drum can oscillate both in axial direction and in the direction of travel. A further oscillation drive is preferably intended for this purpose. The displacement of the milling drum in the direction of travel can be effected not only linearly but also in the shape of an arc about an axis extending above the milling drum and parallel to the milling drum axis.

A controller is preferably intended which controls or regulates the oscillation frequency and/or the amplitude of the oscillation stroke automatically in accordance with the milling drum speed and/or the advance speed and/or the milling depth of the milling drum.

In a preferred embodiment, it is intended for the milling drum to oscillate in axial direction together with the milling drum housing, and for the oscillation drive to drive the milling drum housing relative to the machine frame.

As an alternative to this, it may be intended for the oscillation drive to drive the milling drum in axial direction inside the milling drum housing.

In this arrangement, the milling drum housing is longer in axial direction than the milling drum by, as a minimum, the maximum oscillation stroke.

It is preferably intended for the axial support to be a fixed/floating support in which the fixed bearing is movable in axial direction.

In this arrangement, the oscillation drive may act, on the side of the fixed bearing, axially on a drive shaft of the milling drum extending in the milling drum axis.

The floating bearing allows a movement stroke which, as a minimum, corresponds to the oscillation stroke.

The milling drum may comprise a rotary drive which, on the side of the fixed bearing, drives a drive shaft. If the entire milling drum housing can oscillate in axial direction, this is effected along no less than two linear guides extending in axial direction parallel to the milling drum axis.

In all embodiments, it may be intended for the milling drum housing or the milling drum to be oscillatable in the direction of travel along no less than two linear or arc-shaped guides.

All guides comprise a first guide which guides both vertically and horizontally, and no less than one further second guide extending parallel to the first guide which, as a minimum, guides in horizontal direction.

In this way, it is ensured that the guides will not tension against one another.

The object is also achieved by the method where during the operation an oscillation stroke moving to and fro in axial direction is exercised on the milling drum in axial direction, where the rotating movement of the tools is superimposed with an axial rotating movement parallel to the milling drum axis, the stroke of which is variably adjusted to the line spacing of two axially neighbouring tools.

It is preferably intended for a milling drum rotation frequency in the range between 0.5 Hz and 3 Hz, corresponding to a milling drum speed in the range of 30 rpm to 180 rpm, preferably between 1 Hz and 2.5 Hz or 60 rpm to 150 rpm, respectively, to be combined with an oscillation frequency between 2 Hz and 40 Hz, preferably between 5 Hz and 15 Hz.

Alternatively, the milling drum speed may be in the range between 180 rpm and 600 rpm, corresponding to a milling drum rotation frequency between 3 Hz and 10 Hz, preferably between 240 rpm and 360 rpm or the milling drum rotation frequency between 4 Hz and 6 Hz, respectively, and may be combined with an oscillation frequency of 0.1 Hz to 5 Hz, preferably between 1 Hz and 3 Hz.

In a further development of the method, it may be intended for an oscillating movement in the direction of travel of the milling drum to be superimposed on the axial oscillation of the milling drum transverse to the direction of travel.

Hereinafter, embodiments of the invention are illustrated in more detail with reference to the drawings.

BRIEF DESCRIPTION OF THE DRAWINGS

The following is shown.

DETAILED DESCRIPTION

Figure 1:
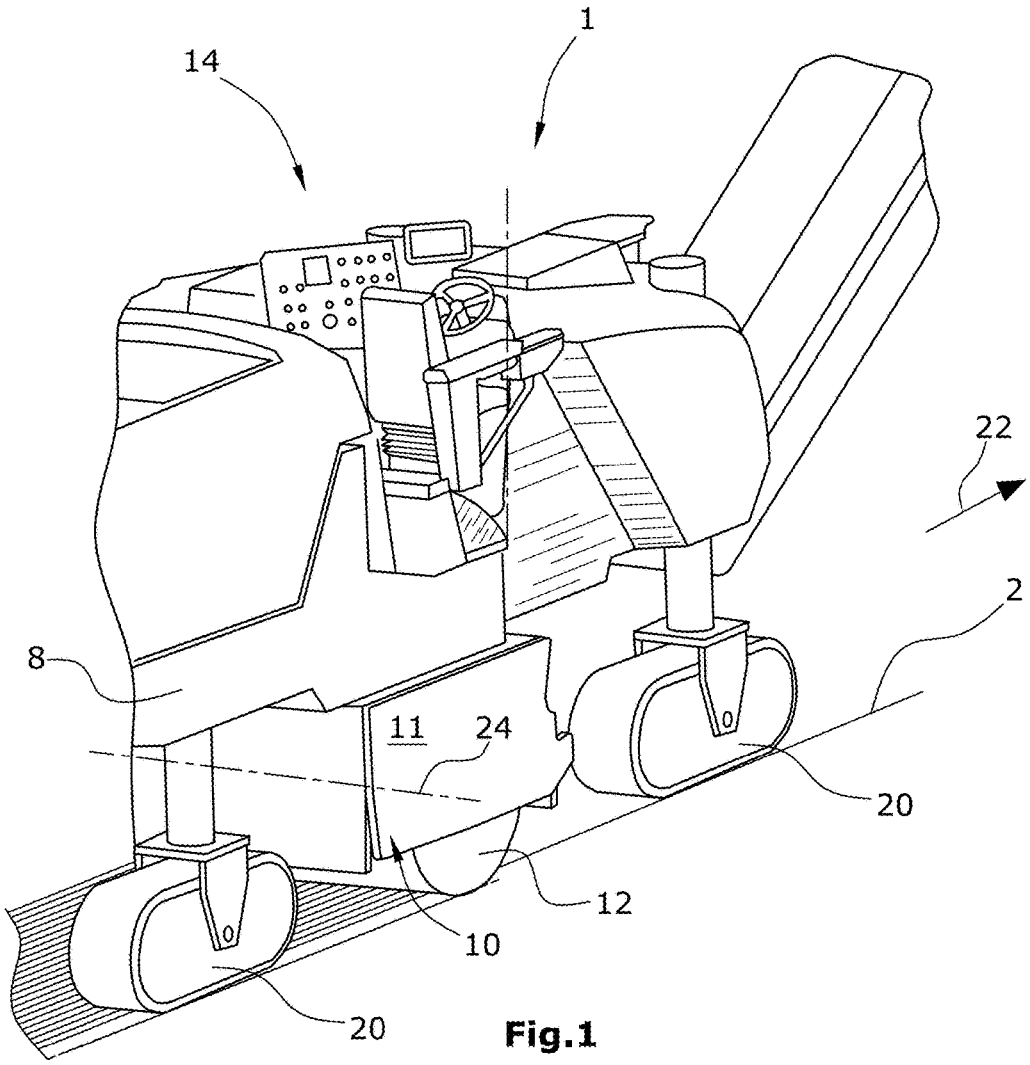
FIG. 1 a perspective view of a road milling machine in the design of a large milling machine, FIG. 2*a* a milling drum with tools arranged in the shape of a helix in accordance with prior art, FIG. 2*b* the texture of a milled road surface, FIG. 2*c* the line spacing of the tools, FIG. 3 a conventional support of the milling drum, FIG. 4 a first embodiment of the invention, FIG. 5 a schematic representation in top view of an axially movable milling drum housing with a milling drum according to FIG. 4 mounted in the same, FIG. 6 a schematic representation of the axial movement of the milling drum inside the milling drum housing according to a second embodiment, FIG. 7 a schematic representation of the linear movement of the milling drum housing in the direction of travel, and FIG. 8 a schematic representation of a linear movement of the milling drum axis in the direction of travel, FIGS. 9 and 10 a schematic representation of a pendulum movement of the milling drum housing or the milling drum, respectively, in the direction of travel, and FIG. 11 a cross-section through the linear guides.

FIG. 1 shows a large milling machine as it is basically known from EP 2 011 921 A (U.S. Pat. No. 7,753,620). The road milling machine 1 comprises a machine frame 8 which is supported by a chassis comprising no less than three tracked ground-engaging units 20 or wheels.

The milling drum housing 10 is arranged between the tracked ground-engaging units 20 as seen in the direction of travel 22, with small milling machines, however, rather level with the rear support wheels or tracked ground-engaging units 20.

The milling drum 12 is rotatable, transverse to the direction of travel 22, about a milling drum axis 24, where the milling drum 12 is supported in side walls 11, 13 of the milling drum housing 10 or at the machine frame 8.

With its one front end, the milling drum 12 may reach up to the outer side of the machine frame 8 called the zero side, while a driving device for the milling drum 12 may be arranged at the opposite outer wall of the machine frame 8. The driving device for the milling drum 12 may, for example, be a mechanical drive comprising a belt drive 38, or a hydraulic or electrical drive.

The operator's platform 14 with a seat for the machine operator is located above the milling drum 12.

Figure 2A:
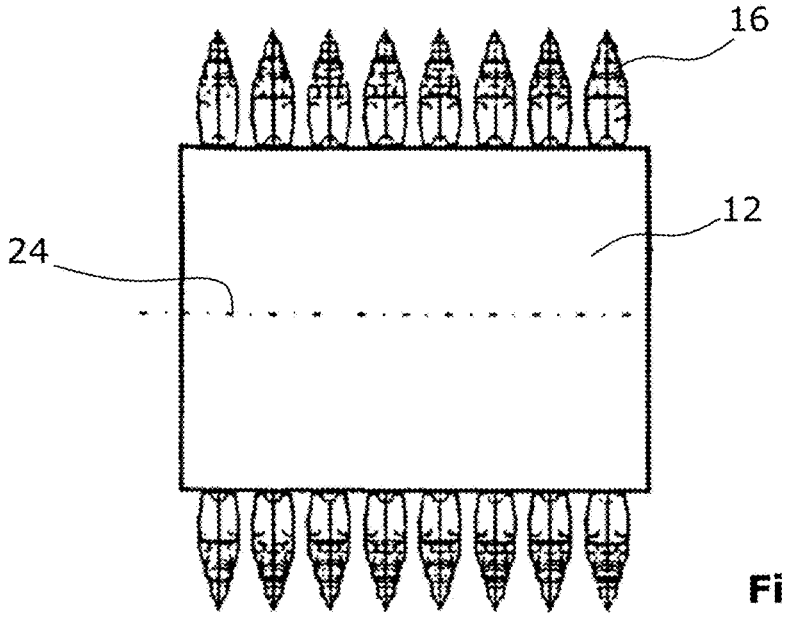
Figure 2B:
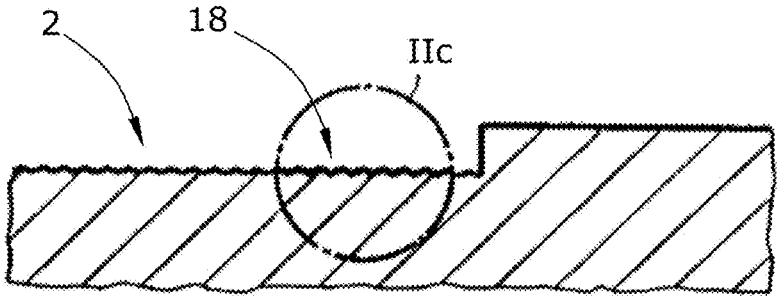

FIG. 2*a* shows, by way of example, the arrangement of the tools 16 on the milling drum 12 as it is basically known from DE 102 03 732 (U.S. Pat. No. 7,422,391). In circumferential direction, the tools 16 feature a specified, mostly constant mutual distance. On each front end of the milling drum 12, a number of tools 16 may be provided which are not arranged in the shape of a helix in order to create vertical milling edges. Since the tools 16 do not change their axial position during rotation of the milling drum 12, they create grooves 18 on the road surface 2 which, in the direction of travel 22, form indentations slot-shaped in cross-section on the road surface 2 as they can be discerned, for example, in FIGS. 2*b* and 2*c*.

The distance 19 between two neighbouring grooves 18 is thus dependent on the line spacing of the milling drum, that is, the axial distance of the neighbouring tools 16 as seen in circumferential direction.

Depending on the milling drum layout, line spacings preferably between 3 mm and 25 mm are common.

Figure 2C:
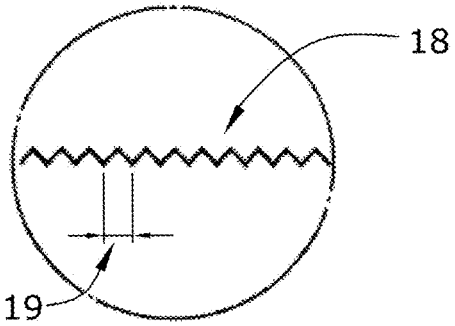

FIG. 2*c* shows, in a schematic representation, the distance 19 between the grooves 18 resulting from the line spacing of the tools 16 arranged on the milling drum 12 in the shape of a helix.

Preferably, two helices of tools 16 running in opposite directions are formed on the milling drum 12, the task of which is to transport the milled material towards the drum centre or towards a specific axial position of the milling drum 12.

Figure 3:
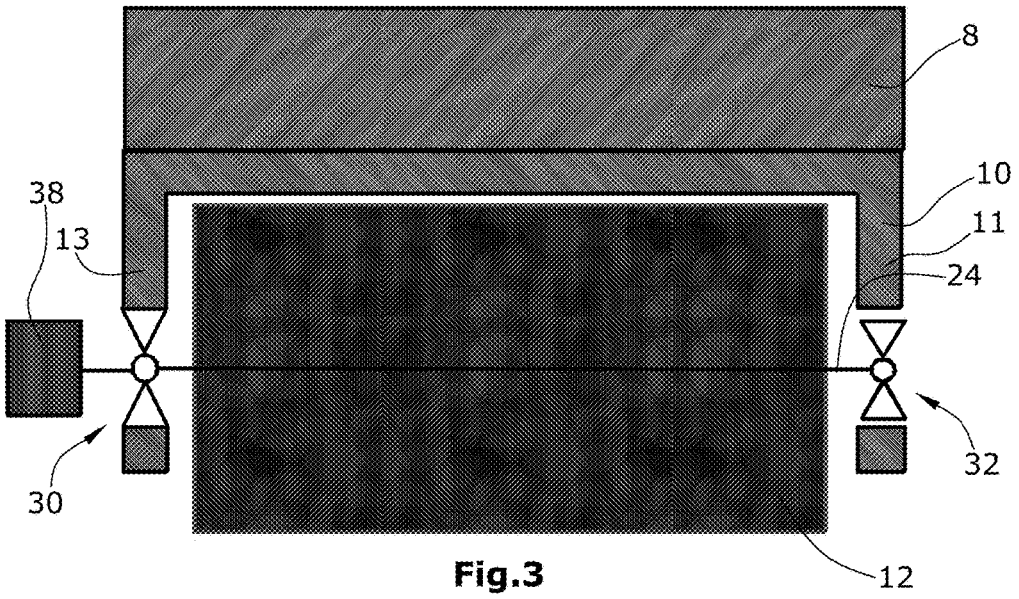

FIG. 3 shows, in a schematic representation, a conventional axial support of a milling drum 12 inside a milling drum housing 10 which is immovable axially relative to the machine frame 8. The milling drum axis 24 is supported in the side walls 11, 13 of the milling drum housing 10 by means of a fixed bearing 30 and a floating bearing 32. The floating bearing is, to a small degree, movable axially so that, for example, any thermal expansions of the milling drum axis 24 can be compensated for.

The milling drum drive is usually arranged preferably on the side of the fixed bearing 30 and may be effected, for example, by means of a mechanical belt drive 38 but also hydraulically or electrically.

The milling drum 12 which according to the invention is supported in the front end walls of the milling drum housing 10 has, aside from a radial support, an axial support movable in axial direction. In this arrangement, the fixed bearing (axial support) of the milling drum is moved relative to the machine frame 8 either with the entire milling drum housing 10 or relative to the same.

Due to the relatively small oscillation stroke according to the invention, a mechanical drum drive is also realizable in this design as only a small axial movement of the belt drive 38 must be effected.

Figure 4:
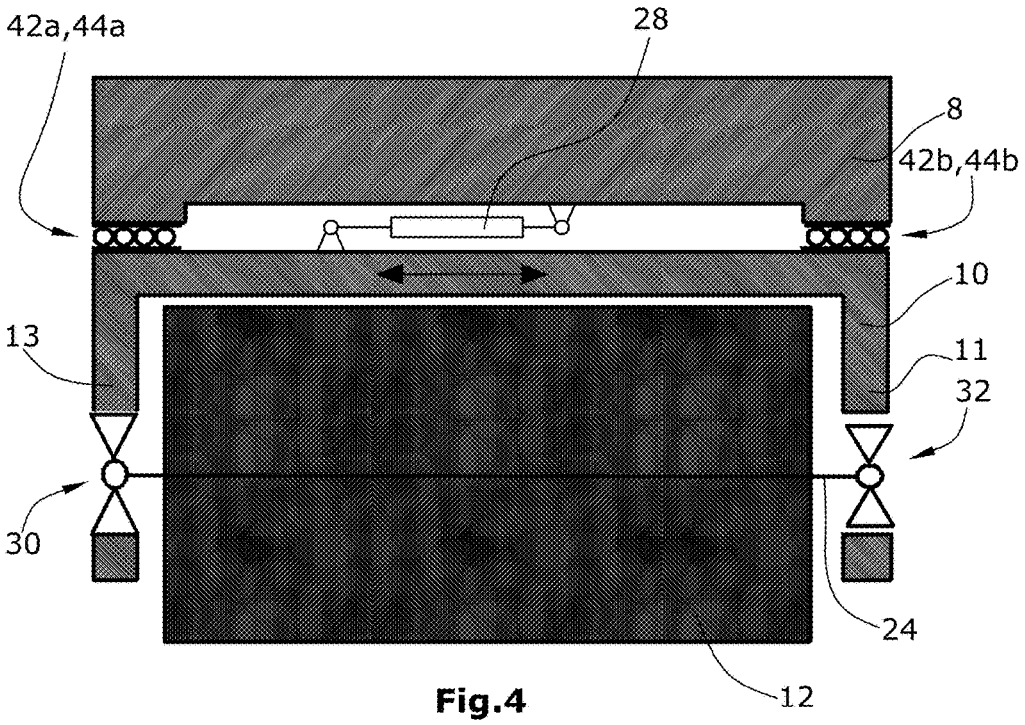
Figure 5:
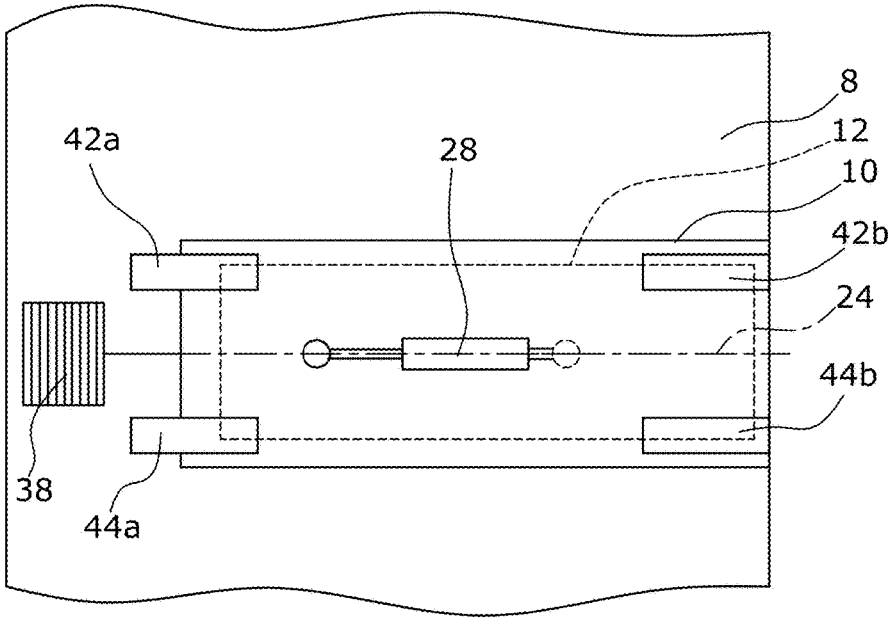

In FIGS. 4 and 5, an embodiment is presented in which the axial movement of the milling drum is achieved in that the entire milling drum housing 10 with the milling drum 12 performs the oscillation stroke. In this arrangement, the oscillation drive 28 acts between the machine frame 8 and the milling drum housing 10.

As can be inferred from FIGS. 4 and 5, the milling drum housing 10 is movable transverse to the direction of travel 22 along no less than two linear guides 42*a*, 44*a* and 42*b*, 44*b* extending parallel to one another in order to enable an oscillation of the entire milling drum housing 10 with the milling drum 12 in axial direction parallel to the milling drum axis 24 in a ground-parallel plane.

An oscillation drive 28, especially a linear drive consisting of, for example, a piston-cylinder unit or a mechanical eccentric drive or a spindle drive, enables oscillation of the milling drum housing 10 relative to the machine frame 8.

FIG. 5 is a schematic top view of the embodiment shown in FIG. 4 from which it can be inferred that the linear guides 42*a*, 42*b* extend parallel to the linear guides 44*a* and 44*b* and to the milling drum axis 24.

As the milling drum housing 10 performs a short stroke only, the guides 42*a*, 42*b*, 44*a*, 44*b* can be designed significantly shorter than in the schematic representation of FIG. 5. It is further understood that each linear guide 42*a*, 42*b* and 44*a*, 44*b*, respectively, may be of integral design. This means that the guiding elements 42*a*, 42*b* and 44*a*, 44*b*, respectively, may be connected to one another or may extend across the entire width of the milling drum housing 10.

Figure 6:
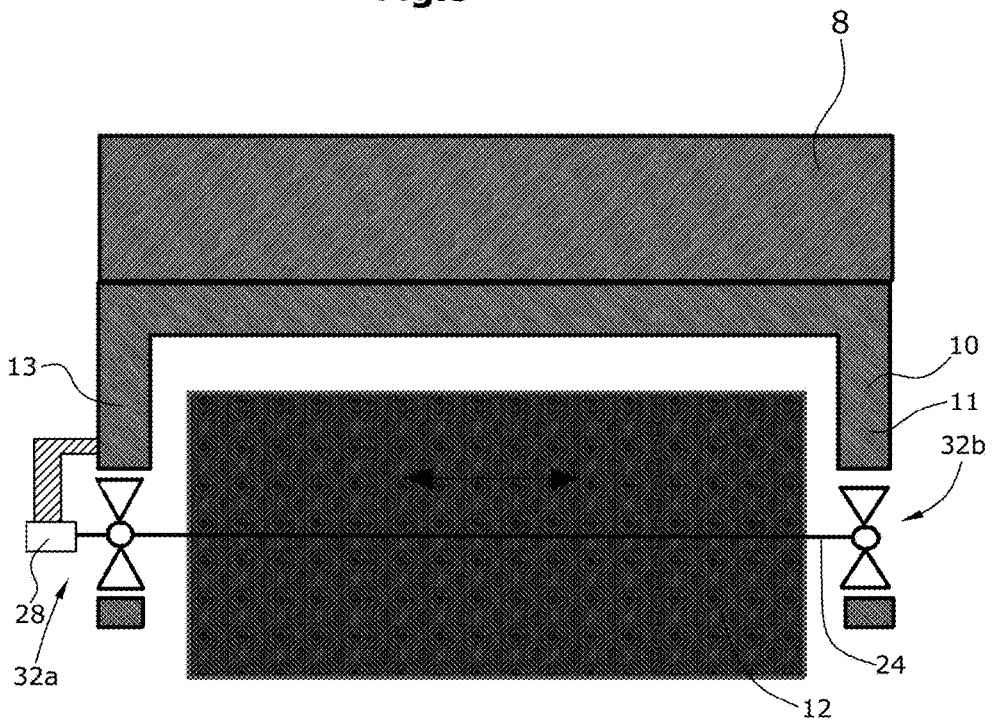

FIG. 6 shows, in a schematic representation, a second embodiment in which the milling drum housing 10 is attached at the machine frame 8 in a rigid fashion and the milling drum 12 is supported in the side walls 11, 13 via floating bearings 32*a*, 32*b*. The oscillation drive 28 acts between the milling drum 12 and the milling drum housing 10. To this effect, the milling drum housing 10 is longer in axial direction than the milling drum 12 by, as a minimum, the maximum oscillation stroke.

Alternatively, a non-depicted axially movable intermediate wall may also be arranged between the side wall 13 and the milling drum 12 in which the one end of the milling drum 12 is supported in a fixed bearing. In this case, the oscillation drive 28 acts between the intermediate wall and the side wall 13.

Figure 7:
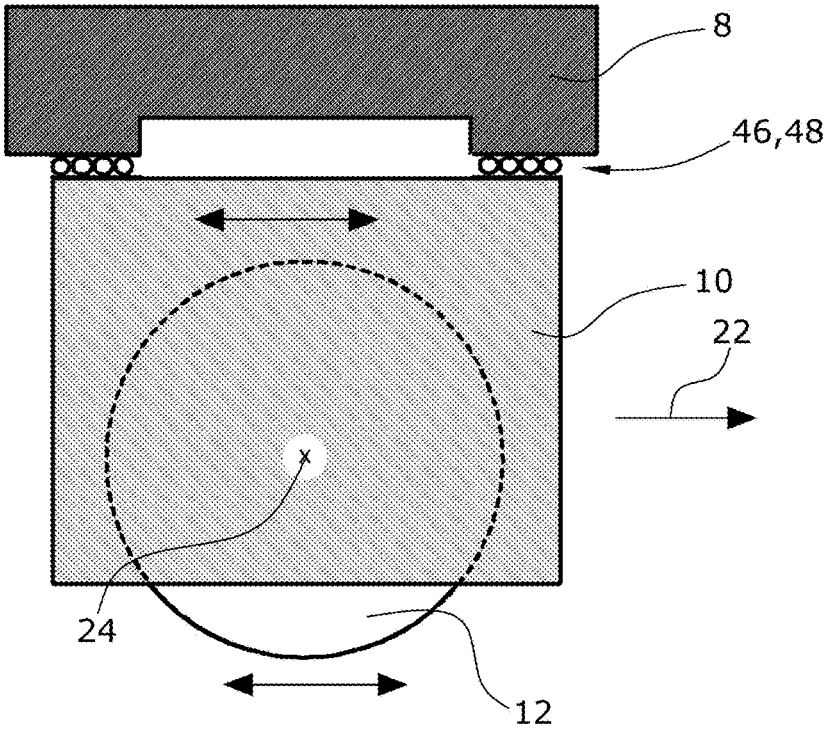
Figure 8:
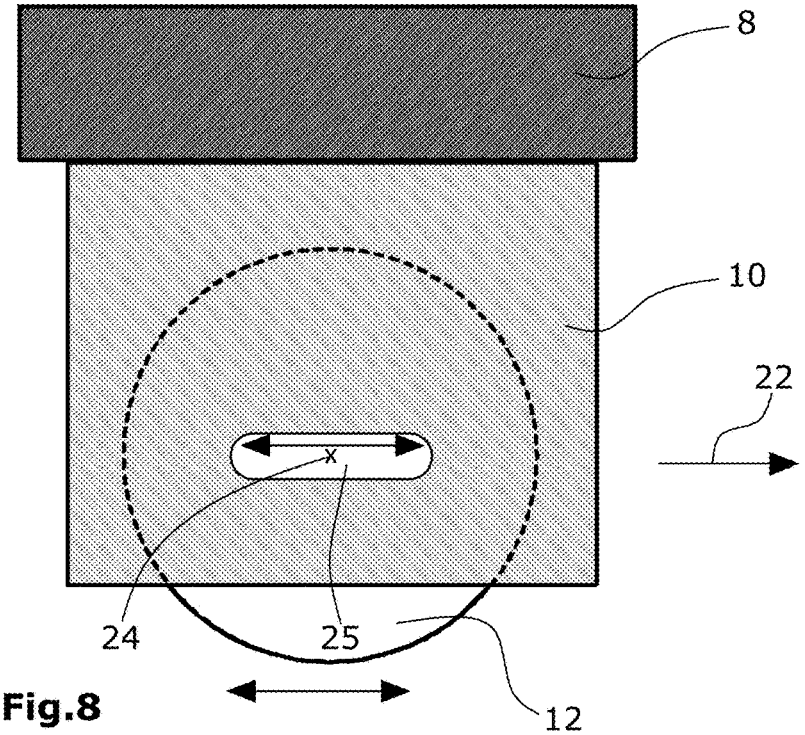

FIG. 7 shows, in a schematic representation, the oscillating movement of the milling drum housing 10 in the direction of travel 22, while FIG. 8 concerns an embodiment in which the milling drum 12 can oscillate in the direction of travel within the side walls 11, 13.

An additional oscillating movement parallel to the direction of travel 22 can be created by means of two additional linear guides 46, 48 depicted in FIG. 7 which extend orthogonally to the linear guides 42, 44 so that not only an axial oscillating movement can be superimposed on the rotating movement of the tools 16 but also an additional oscillating movement parallel to the direction of travel 22.

In the embodiment shown in FIG. 8, the milling drum axis 24 is guided inside the milling drum housing 10 in a horizontal slot 25.

The linear guides 42, 44, 46, 48 may, for example, also be intended in the design of a compound slide.

The amplitude and/or the frequency of the oscillation in axial direction as well as parallel to the direction of travel 22 are variably adjustable. For example, the oscillation stroke can be adjusted in a range between the 0.5-fold to 1.5-fold of the line spacing. The maximum oscillation stroke is preferably guided by the line spacing, however, and deviates only slightly from the same.

For example, the oscillation stroke is adjustable in a range between 3 mm, preferably 5 mm, and 40 mm.

The frequency of oscillation can be adjusted between 0.1 Hz and 40 Hz.

Alternatively, the frequency may also be adjusted so that a specific relation is achieved between the average axial speed magnitude and the advance speed of the milling drum 12 or the circumferential speed of the tools of the milling drum 12 or the sum of the circumferential speed of the tools and the advance speed of the milling machine.

According to a further alternative, it may be advantageous to combine a specific milling drum speed range with a range of the oscillation frequency adjusted to the same.

For example, a relatively high milling drum speed in the range between 180 rpm to 600 rpm (or milling drum rotation frequency between 3 Hz to 10 Hz), preferably between 240 rpm to 360 rpm (or 4 Hz to 6 Hz), may be combined with a relatively low oscillation frequency between 0.1 Hz to 5 Hz, particularly preferably between 1 Hz to 3 Hz.

In this arrangement, the oscillation frequencies refer to the specified range for the oscillation stroke.

According to another, particularly preferred embodiment, a low milling drum speed may be combined with a high oscillation speed.

In this case, the milling drum speed may be in the range between 30 rpm to 180 rpm (corresponding to a milling drum rotation frequency of 0.5 Hz to 3 Hz), preferably between 60 rpm to 150 rpm (corresponding to 1 Hz to 2.5 Hz), with an oscillation frequency in the range between 2 Hz to 40 Hz, preferably between 5 Hz to 15 Hz.

As a general rule, this embodiment is to be preferred as it enables lower tool wear and tear to be achieved (lower circumferential speed of the cutting tools, that is, lower forces on the tool in the cut).

The oscillation frequency should not correspond to an integral multiple of the rotation frequency of the milling drum (or vice versa), as this would enable the cut to always be performed in the same line extending in the direction of travel. This effect is, however, negligible in case of fast oscillation, for example, the fivefold drum rotation frequency.

Integral multiples of half the rotation frequency must also be avoided in case of an oscillation stroke corresponding to the line spacing, as the cut will otherwise always be effected in the same line, or the neighbouring line, of the linear texture extending in the direction of travel.

Finally, a variable oscillation frequency is also possible by superimposing with a harmonic wave of the rotation frequency of the milling drum, for example, with a frequency range of 30% around the oscillation frequency.

The superimposed oscillation movement of the milling drum 12 parallel to the direction of travel 22 may also, instead of linear as illustrated in FIGS. 7 and 8, be effected in the shape of a circular arc about a pivoting axis 50 extending above and parallel to the milling drum axis 24.

Figure 9:
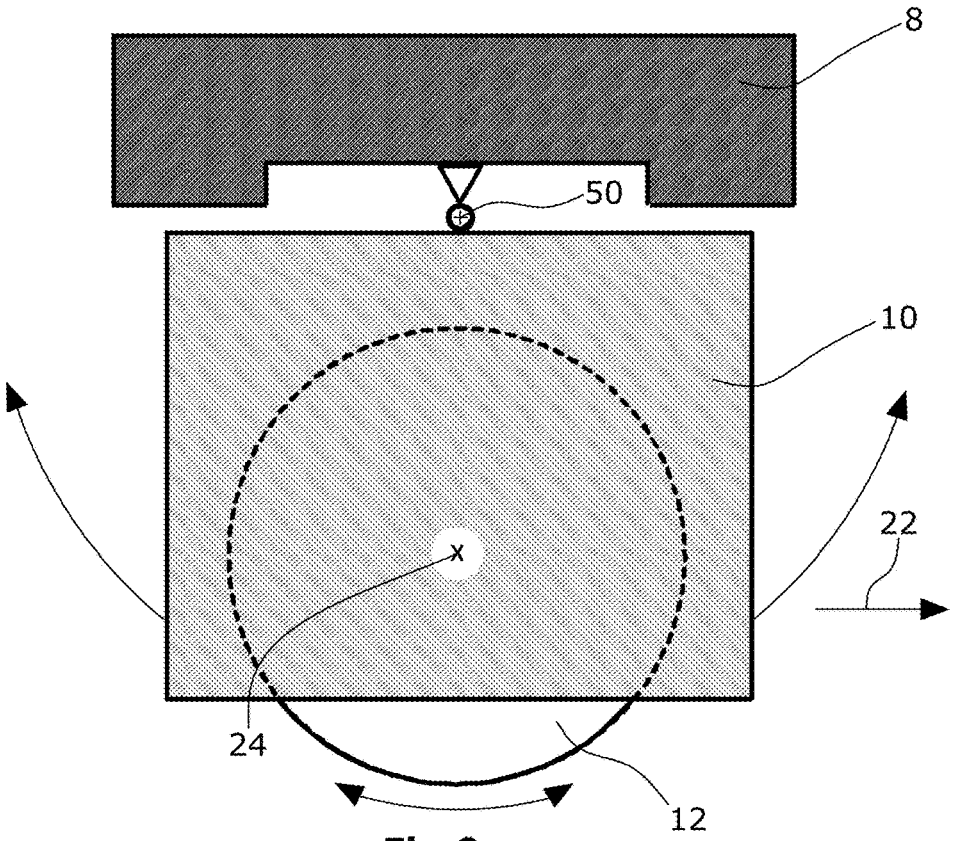

In this context, FIG. 9 shows an embodiment in which the milling drum housing 10 with the milling drum 12 can oscillate, in the direction of travel 22, about the pivoting axis 50 in the shape of an arc.

Figure 10:
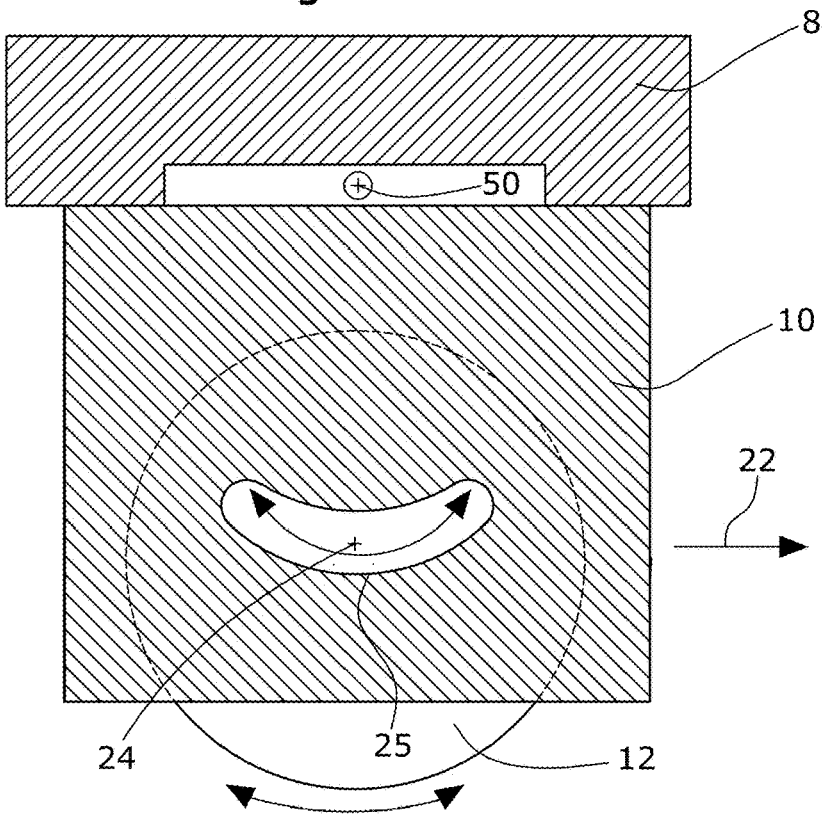

FIG. 10 shows an alternative embodiment in which the milling drum 12 can oscillate, in the direction of travel 22, about the pivoting axis 50 inside the milling drum housing 10. In this case, the slot 25 is arranged around the pivoting axis 50 in the side walls 11 of the milling drum housing 10 curved in the shape of an arc.

Figure 11:
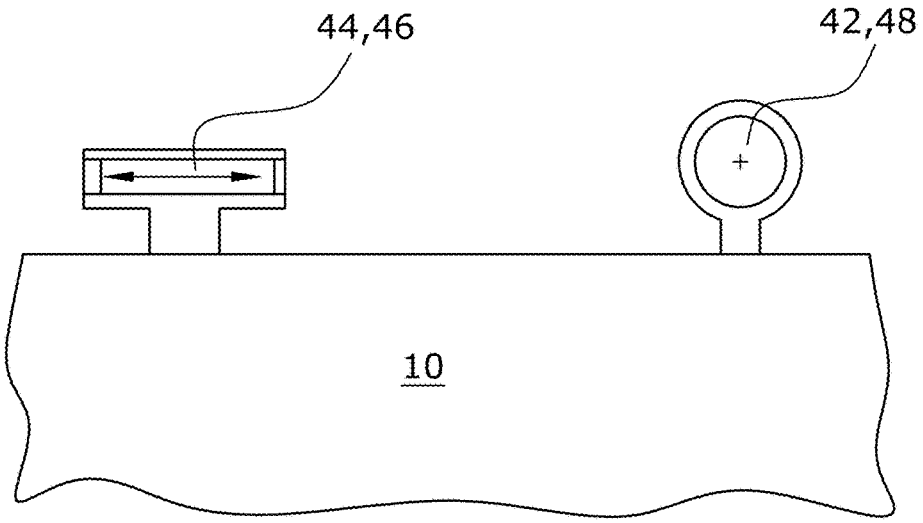

FIG. 11 shows a cross-section of the longitudinal guides 42, 44, 46, 48, from which it can be inferred that one each of the two guides 42, 48 extending parallel to one another features a single degree of freedom only, namely, in axial direction, and the other guide 44, 46, respectively, features a degree of freedom in axial direction and a degree of freedom in horizontal direction. This design of the guides is suitable both for the linear guides 42, 44 acting in axial direction and for the linear guides 46, 48 acting in the direction of travel.

The road milling machine may comprise a controller 14 which controls or regulates the oscillation frequency and/or the oscillation amplitude automatically in accordance with the milling drum speed and/or the advance speed of the milling machine and/or the milling depth of the milling drum. In addition, parameters of the road surface can be taken into account, for example, the consistency of the road surface.

The invention claimed is:

1. A self-propelled road milling machine for working road surfaces, comprising:

a machine frame;

a milling drum supported from the machine frame to be rotatable about an axis of the milling drum, the axis extending transverse to a direction of travel of the road milling machine, the milling drum including a plurality of working tools arranged around a circumference of the milling drum, the tools being spaced from each other by a line spacing parallel to the axis;

a milling drum housing enclosing the milling drum; and an oscillation drive configured to oscillate the milling drum to-and-fro by an oscillation stroke parallel to the axis and relative to the machine frame during milling operation, such that a rotating movement of the tools due to rotation of the milling drum is superimposable with an axial movement of the tools parallel to the axis of the milling drum due to the oscillation of the milling drum.

2. The road milling machine of claim 1, wherein:

the oscillation drive is configured such that an amplitude of the oscillation stroke is adjustable.

3. The road milling machine of claim 2, wherein:

the oscillation drive is further configured such that the amplitude of the oscillation stroke is in a range from 0.5 to 1.5 times the line spacing.

4. The road milling machine of claim 2, wherein:

the oscillation drive is further configured such that the amplitude of the oscillation stroke is in a range from 0.9 to 1.1 times the line spacing.

5. The road milling machine of claim 2, wherein:

the oscillation drive is further configured such that the amplitude of the oscillation stroke is in a range from 3 mm to 40 mm.

6. The road milling machine of claim 1, wherein:

the oscillation drive is configured such that a frequency of the oscillation stroke is adjustable.

7. The road milling machine of claim 6, wherein:

the oscillation drive is further configured such that the frequency of the oscillation stroke is between 0.1 Hz and 40 Hz.

8. The road milling machine of claim 1, wherein:

a ratio of an average axial speed of the tools to a circumferential speed of the tools is in a range from 0.1 to 3.

9. The road milling machine of claim 1, wherein:

a ratio of an average axial speed of the tools to a circumferential speed of the tools is in a range from 0.25 to 2.

10. The road milling machine of claim 1, further comprising:

an axial support for the milling drum, the axial support being movable relative to the machine frame parallel to the axis.

11. The road milling machine of claim 10, wherein:

the oscillation drive is configured such that a to-and-fro movement in the direction of travel is superimposable on the axial support.

12. The road milling machine of claim 1, further comprising:

a controller configured to control at least one of a frequency of the oscillation stroke and an amplitude of the oscillation stroke automatically in accordance with at least one of a milling drum rotational speed, an advance speed and a milling depth of the milling drum.

13. The road milling machine of claim 1, wherein:

the milling drum and the milling drum housing are configured such that the milling drum oscillates parallel to the axis together with the milling drum housing; and the oscillation drive is configured to oscillate the milling drum housing relative to the machine frame.

14. The road milling machine of claim 13, further comprising:

at least two linear guides supporting the milling drum housing for oscillation parallel to the axis relative to the machine frame.

15. The road milling machine of claim 1, wherein:

the oscillation drive is configured to oscillate the milling drum parallel to the axis relative to the milling drum housing.

16. The road milling machine of claim 15, wherein:

the milling drum includes a drive shaft supported at one end in a fixed bearing and at another end in a floating bearing; and the oscillation drive is located on the side of the milling drum of the fixed bearing and acts axially on the drive shaft.

17. The road milling machine of claim 1, wherein:

one of the milling drum housing and the milling drum is oscillatable in the direction of travel along no less than two linear or arc-shaped guides.

18. A method of working a road surface with a road milling machine, the milling machine including a machine frame and a milling drum supported from the machine frame, the milling drum being rotatable about an axis of the milling drum, the axis extending transverse to a direction of travel of the road milling machine, the milling drum including a plurality of working tools arranged around a circumference of the milling drum, the tools being axially spaced from each other by a line spacing, the method comprising:

(a) operating the milling machine to work the road surface by rotating the milling drum and thereby providing a rotating movement of the working tools about the axis of the milling drum while advancing the milling machine in the direction of travel with the working tools engaging the road surface; and (b) during step (a), moving the milling drum to-and-fro in an oscillation stroke parallel to the axis of the milling drum and relative to the machine frame, and thereby superimposing an oscillating movement on the working tools parallel to the axis of the milling drum.

19. The method of claim 18, further comprising:

adjusting an amplitude of the oscillation stroke.

20. The method of claim 18, further comprising:

automatically controlling at least one of an oscillation frequency of the oscillation stroke and an oscillation amplitude of the oscillation stroke in accordance with at least one of a milling drum rotational speed, an advance speed of the milling machine, a milling depth of the milling drum, and a parameter of the road surface.

21. The method of claim 18, wherein:

in step (a) the milling drum rotates at a rotational speed in a range from 180 rpm to 600 rpm; and in step (b) the oscillation stroke has an oscillation frequency in a range from 0.1 Hz to 5 Hz.

22. The method of claim 18, wherein:

in step (a) the milling drum rotates at a rotational speed in a range from 30 rpm to 180 rpm; and in step (b) the oscillation stroke has an oscillation frequency in a range from 2 Hz to 40 Hz.

* * * * *